US006692301B2

(12) United States Patent
Okayasu et al.

(10) Patent No.: US 6,692,301 B2
(45) Date of Patent: Feb. 17, 2004

(54) CONNECTOR

(75) Inventors: Yasushi Okayasu, Yokkaichi (JP); Kiyofumi Ichida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/241,251

(22) Filed: Sep. 10, 2002

(65) Prior Publication Data

US 2003/0087551 A1 May 8, 2003

(30) Foreign Application Priority Data

Nov. 5, 2001 (JP) ..... 2001-339509

(51) Int. Cl.[7] ..... H01R 13/40
(52) U.S. Cl. ..... 439/587; 439/595
(58) Field of Search ..... 439/587, 588, 439/275, 752.5, 595

(56) References Cited

U.S. PATENT DOCUMENTS

| | | | | |
|---|---|---|---|---|
| 4,776,813 | A | 10/1988 | Wilson et al. | 439/587 |
| 4,900,271 | A | 2/1990 | Colleran et al. | 439/595 |
| 5,520,553 | A | 5/1996 | Cecil, Jr. et al. | 439/595 |
| 5,569,051 | A | 10/1996 | Endo et al. | 439/587 |
| 5,645,451 | A | 7/1997 | Ohsumi et al. | 439/587 |
| 5,941,737 | A | 8/1999 | Sakai et al. | 439/752 |
| 6,071,147 | A | 6/2000 | Tsukamoto | 439/587 |
| 6,217,394 | B1 | 4/2001 | Sugie | 439/752.5 |
| 6,250,962 | B1 | 6/2001 | Shinozaki | 439/587 |
| 6,254,428 | B1 | 7/2001 | Murakami et al. | 439/556 |
| 2002/0052142 | A1 * | 5/2002 | Ishikawa et al. | 439/587 |

FOREIGN PATENT DOCUMENTS

| | | |
|---|---|---|
| JP | 6-203902 | 7/1994 |

* cited by examiner

*Primary Examiner*—Michael C. Zarroli
(74) *Attorney, Agent, or Firm*—Gerald E. Hespos; Anthony J. Casella

(57) ABSTRACT

A rubber plug (30) is disposed on a rear surface of a male housing (10). A plug hold-down plate (40) for holding down the rubber plug (30) is disposed on a rear surface of the rubber plug (30). A holder (50) can be held at a temporary locking position apart from a rear surface of the plug hold-down plate (40) and a main locking position at which the holder (50) contacts the rear surface of the plug hold-down plate (40). If a mounted male terminal fitting (2) is pulled out, with the holder (50) held at the temporary locking position, the plug hold-down plate (40) holds down the rubber plug (30). Thus the rubber plug (30) can be prevented from moving rearward.

11 Claims, 11 Drawing Sheets

CONNECTOR

BACKGROUND OF THE INVENTION

1. Field of the Invention

The invention relates to a waterproof connector.

2. Description of the Related Art

A known waterproof connector has a housing with at least one cavity capable of accommodating a male terminal fitting. A collective type rubber plug is disposed on the rear of the housing and has an electric wire insertion hole aligned with the cavity. The rubber plug is held by a holder mounted in contact with the rear surface of the rubber plug. The holder has a through-hole corresponding to both the cavity of the housing and the electric wire insertion hole of the rubber plug. The male terminal fitting is inserted into the through-hole of the holder, through the electric wire insertion hole of the rubber plug and into the cavity of the housing. A connector with a collective type rubber plug is shown in Japanese Patent Application Laid-Open No. 6-203902

The male terminal fitting of the above-described connector could be inserted obliquely into the through-hole. Hence, there is a possibility that a tab at the front end of the male terminal fitting could strike against the inner surface of the electric wire insertion hole and damage the rubber plug.

The present applicant proposed the connector disclosed in Japanese Patent Appl. No. 2001-148700 in an effort to solve the above referenced problem. This connector positions the holder rearward of the rubber plug while inserting the male terminal fitting into the cavity. The inner surface of the through-hole guides the body of the male terminal fitting and corrects the posture of the male terminal fitting before the front end of the tab thereof reaches the rubber plug. The holder then is pressed into a position where the holder contacts the rubber plug. Therefore it is possible to hold the rubber plug securely and make the connector compact.

An operator may conclude that the male terminal fitting was inserted incorrectly or inserted into the wrong cavity, and may remove the male terminal fitting from the cavity before pressing the holder to the position where the holder contacts the rubber plug. In this state, the rubber plug is not held down by the holder. Thus there is a possibility that the male terminal fitting removal operation causes the rubber plug to be dislocated rearward.

The present invention has been made in view of the above-described problem. Accordingly, it is an object of the present invention to prevent dislocation of a rubber plug in removing a terminal fitting from a cavity.

SUMMARY OF THE INVENTION

The present invention relates to a waterproof connector with a housing that has a plurality of cavities and a male terminal fitting mounted in each cavity. Each male terminal fitting has a relatively thick body and a relatively thin tab that projects forward from the body. A collective-type rubber plug is disposed on a rear surface of the connector housing, and is capable of closely contacting a periphery of each of the male terminal fittings. The plug also has a plurality of electric wire insertion holes corresponding to the cavities respectively. The connector also includes a holder with a plurality of terminal insertion holes that correspond respectively to the electric wire insertion holes. The plug can be held in the connector housing at a temporary locking position disposed rearward from a rear surface of the rubber plug and a main locking position disposed forward from the temporary locking position.

The male terminal fittings are inserted into the cavities through the terminal insertion holes of the holder and the electric wire insertion holes of the plug, while the holder is held at the temporary locking position. The posture of each of the male terminal fitting is corrected during the terminal insertion process by fitting the body part of each terminal fitting in the corresponding terminal insertion hole of the holder. The holder is moved from the temporary locking position to the main locking position after the male terminal fittings are inserted into the respective cavities. The housing has a rubber plug hold-down member that is separate from the holder and that prevents the rubber plug from moving freely rearward when the holder is at the temporary locking position.

The rubber plug hold-down member preferably is a substantially flat plate and is aligned substantially perpendicular to an insertion direction of the male terminal fittings. Thus, a front surface of the rubber plug hold-down member holds down the rear surface of the rubber plug. A reinforcing rib preferably projects from the rear surface of the rubber plug hold-down member, and an escape cavity is formed on the holder for accommodating the rib.

According to the above construction, the male terminal fitting is inserted into the terminal insertion hole of the holder while the holder is held at the temporary locking position. Thus, the posture of the male terminal fitting is corrected by the terminal insertion hole of the holder and it is possible to prevent the tab from sticking into the rubber plug.

The holder is pressed forward and held at the main locking position after the male terminal fitting has been inserted. Accordingly, it is possible to reduce the dimension from the front end surface of the housing to the rear end surface of the holder.

The rubber plug hold-down member prevents the collective-type rubber plug from moving freely rearward. More particularly, an operator may insert the male terminal fitting into the cavity with the holder held at the temporary locking position and then may pull out the male terminal fitting before moving the holder to the main locking position. However, rubber plug hold-down member prevents the rubber plug from moving rearward together with the male terminal fitting.

The flat plate shape of the rubber plug hold-down member reduces the space for mounting the rubber plug hold-down member. Thus, the housing has a short longitudinal dimension. The flat shape also makes the rubber plug hold-down member weak, and creates a possibility that the rubber plug hold-down member will undergo a bending deformation. However, the reinforcing rib gives the rubber plug hold-down member the necessary strength to prevent deformation.

The escape cavity on the holder accommodates the rib when the holder is pressed into the main locking position. Thus, it is possible to mount the holder on the rubber plug hold-down member, with the holder in substantially close contact with the rubber plug hold-down member. Accordingly it is possible to reduce the dimension from the front end surface of the housing to the rear end surface of the holder.

DETAILED DESCRIPTION OF THE PREFERRED EMBODIMENTS

Figure 1:
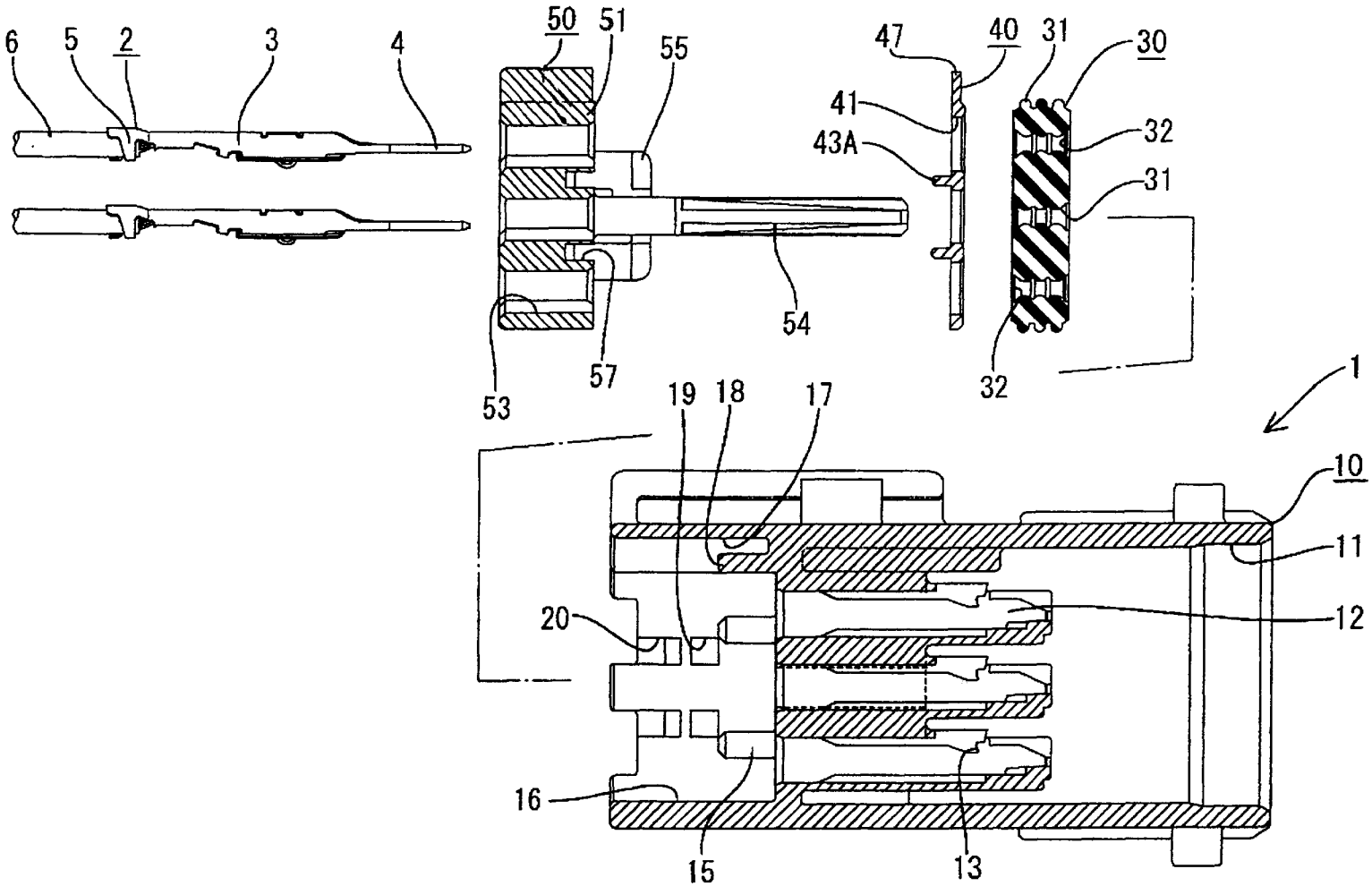
FIG. 1 is an exploded sectional view showing an embodiment of the present invention.

A male waterproof connector in accordance with the invention and is identified by the numeral 1 in FIG. 1. The connector 1 includes a male housing 10, male terminal fittings 2, a collective-type rubber plug 30, a plug hold-down plate 40, and a holder 50. The right-hand side in FIG. 1 is referred to as the forward side herein.

Each male terminal fitting 1 has an almost square tubular body 3. A tab 4 projects forward from the front end of the body 3 and is thinner and narrower than the body 3. A barrel 5 is at the rear end of the body 3 and is configured for crimped connection with an electric wire 6.

The male housing 10 is flat and quadrangular and is molded unitarily from a synthetic resin. A hood 11 opens forward at the front end of the housing 10 and is capable of fitting on a mating female connector (not shown). A plug mounting receptacle 16 opens rearwardly at the rear end of the male housing 10 and is capable of accommodating the collective-type rubber plug 30, the plug hold-down plate 40, and the holder 50. Cavities 12 extend between the hood 11 and the plug mounting receptacle 16 of the male housing 10 and are capable of accommodating the male terminal fittings 2.

Figure 2:
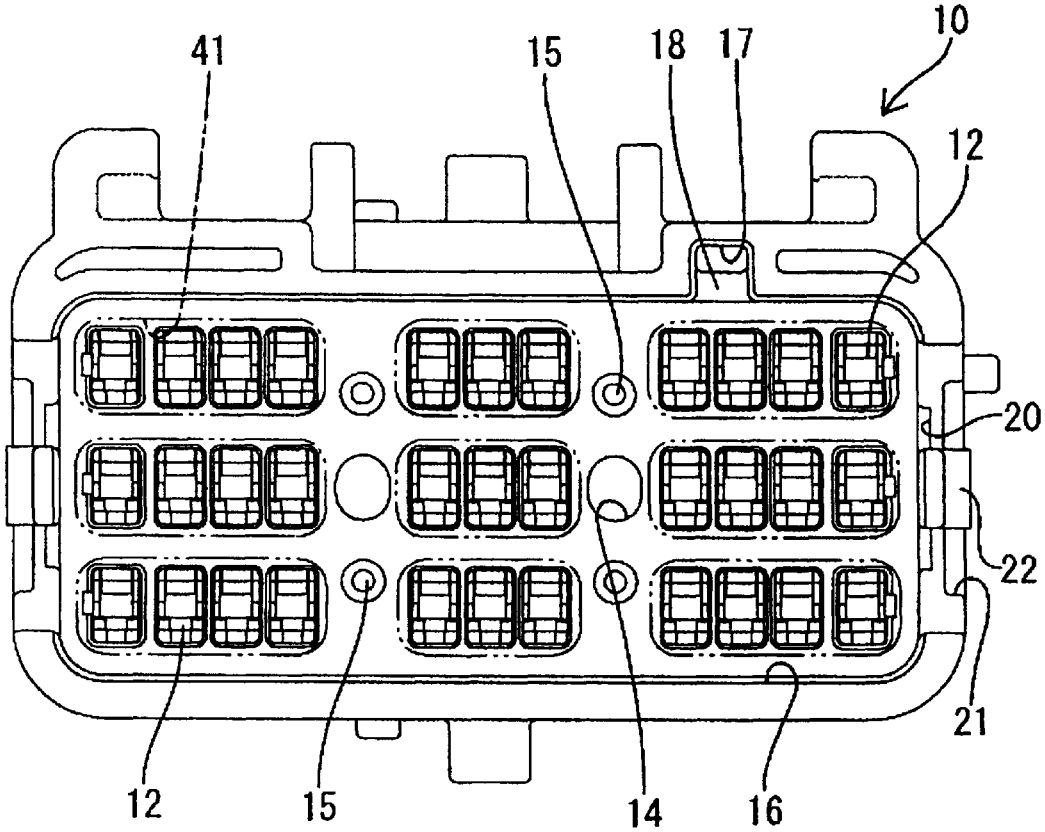
FIG. 2 is a rear view showing a male housing.

The cavities 12 are disposed in a plurality of blocks each consisting of three or four cavities 12 arranged side by side. The cavities 12 are arranged in three stages in the vertical direction of the male housing 10, and in three rows in the widthwise direction thereof (see FIG. 2).

An elastically flexible lance 13 is mounted on a ceiling wall of each cavity 12. The lance 13 catches the body 3 of the male terminal fitting 2 and securely holds the male terminal fitting 2 in the respective cavity 12.

Figure 9:
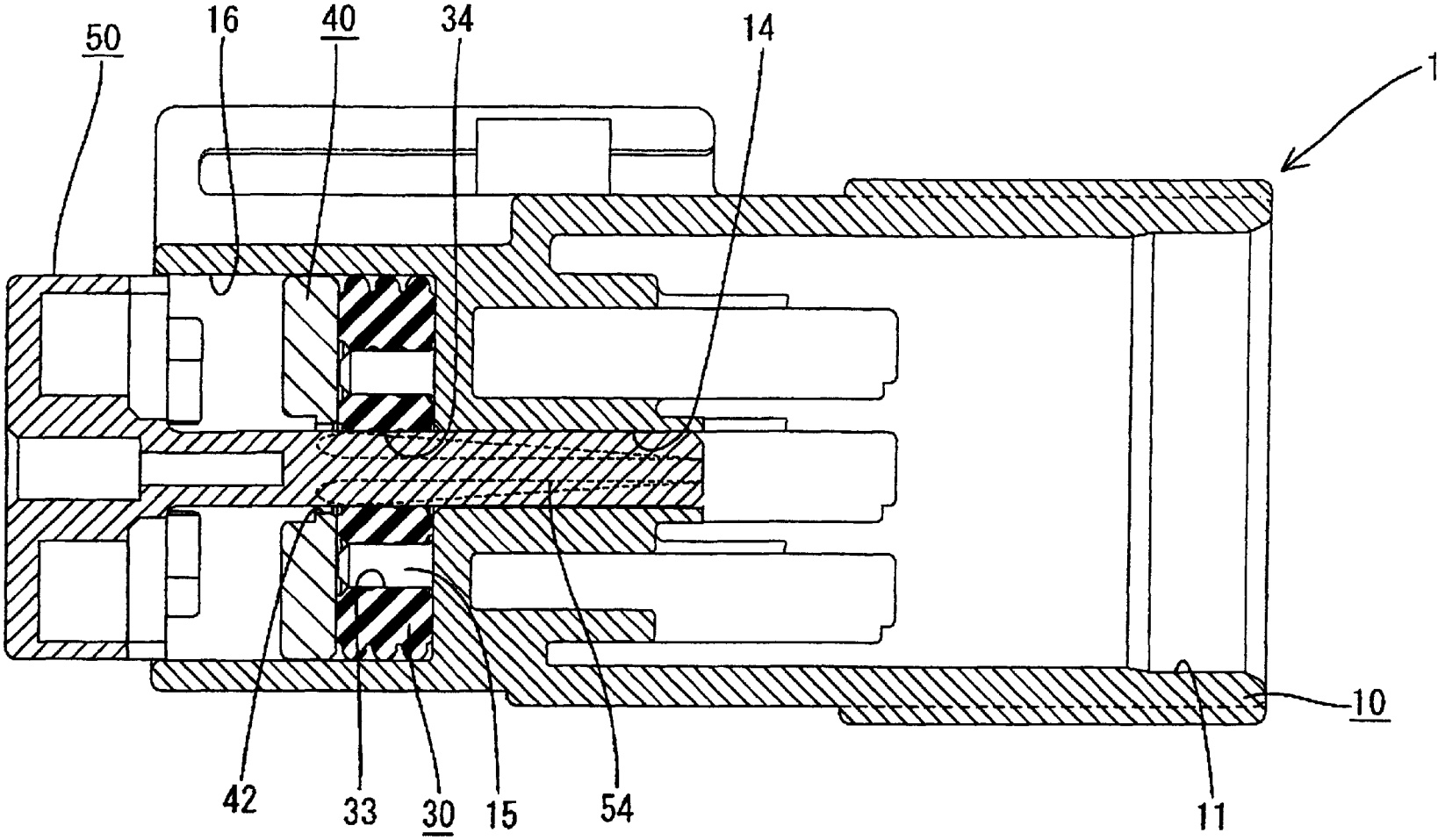
FIG. 9 is a side sectional view showing a state in which a projection of the holder is inserted into projection insertion holes.

The collective-type rubber plug 30 is installed in the front end of the plug mounting receptacle 16 such that the rubber plug 30 is in close contact with the innermost surface of the plug mounting receptacle 16. The rubber plug 30 is sized to cover the region in which all the cavities 12 are formed. Lips 31 are formed on the peripheral surface of the rubber plug 30 and are dimensioned for contacting the inner surface of the plug mounting receptacle 16. The rubber plug has a positioning hole 33 that receives a convexity 15 that projects from the innermost surface of the plug mounting receptacle 16. Thus the rubber plug 30 is placed in position accurately (see FIG. 9).

A plurality of circular electric wire insertion holes 32 penetrate longitudinally through the rubber plug 30 in correspondence to the respective cavities 12. Lips 31 are formed on the inner peripheral surface of each electric wire insertion hole 32 and are dimensioned for closely contacting the peripheral surface of the electric wire 6 inserted into the electric wire insertion hole 32.

Figure 3:
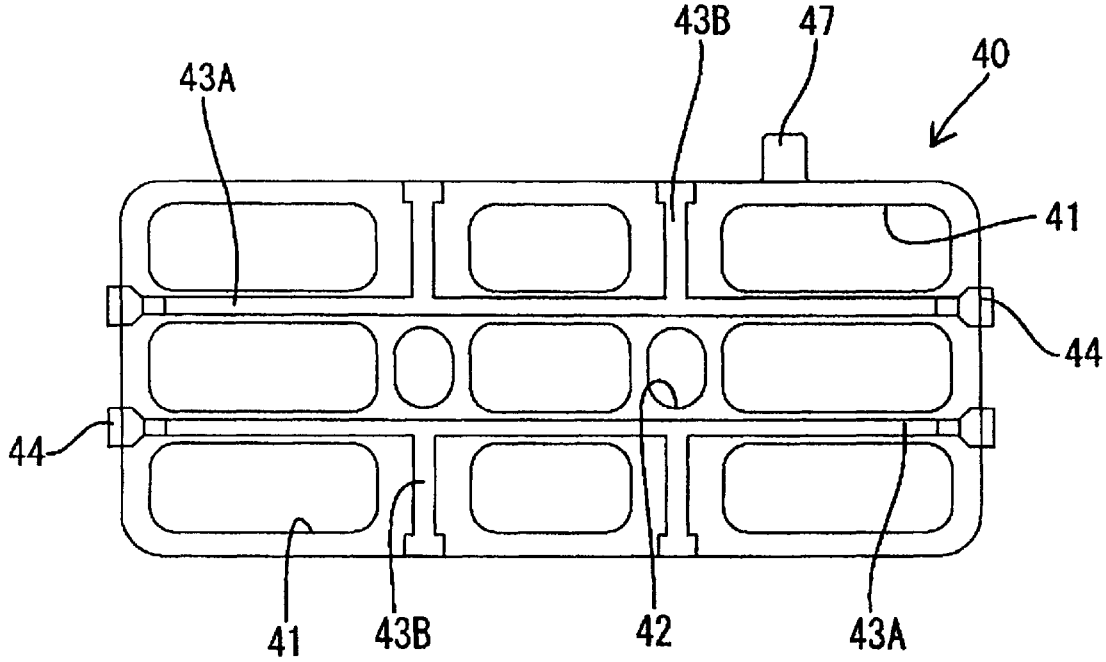
FIG. 3 is a rear view showing a rubber plug hold-down member.
Figure 4:
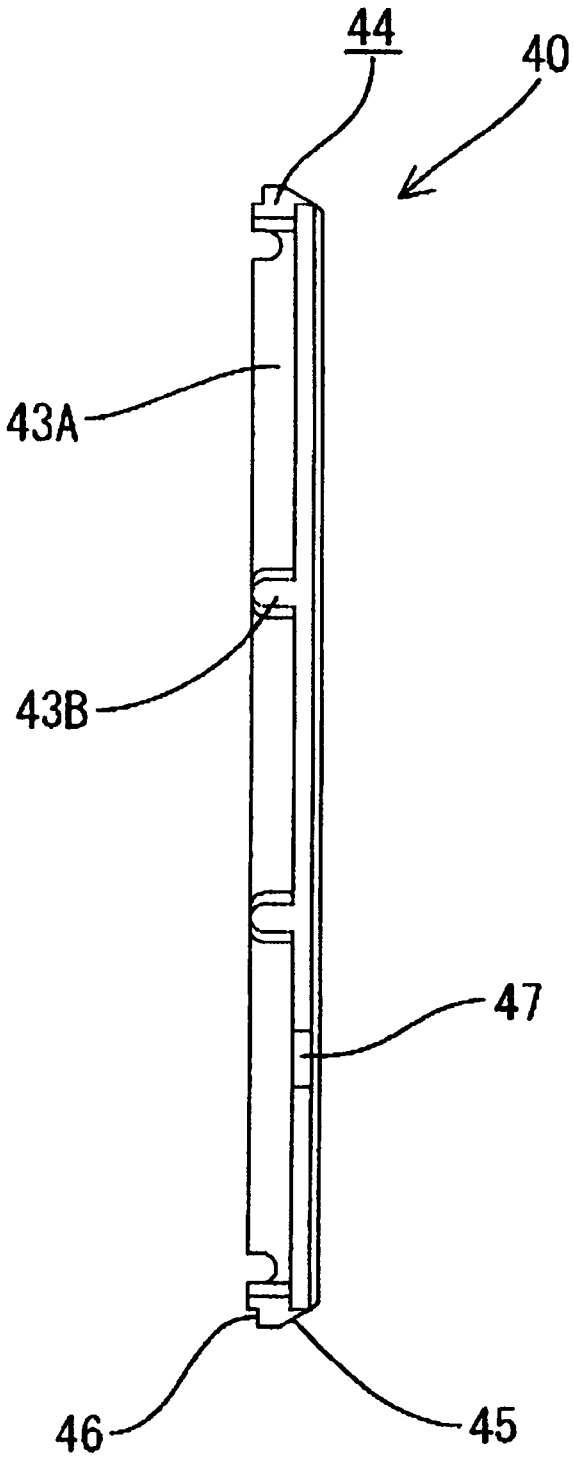
FIG. 4 is a plan view showing the rubber plug hold-down member.

The plug hold-down plate 40 is mounted on a rear surface of the rubber plug 30. As shown in FIGS. 3 and 4, the hold-down plate 40 is a substantially flat plate aligned perpendicular to an insertion direction of the male terminal fitting 2. The plug hold-down plate 40 is almost quadrangular and is capable of fitting on the inner surface of the plug mounting receptacle 16 without loosening the plug hold-down plate 40. Transversely long, generally rectangular through-holes 41 are formed in the plug hold down plate 40 and correspond to each block of the cavities 12. The male terminal fitting 2 that is inserted into each cavity 12 is freely inserted into the through-hole 41 (see FIG. 2).

Two projection insertion holes 42 are formed at the sides of the through-hole 41 disposed at the center in FIG. 3.

Reinforcing ribs 43A and 43B project from locations on the rear surface of the plug hold-down plate 40 between the through-holes 41. More specifically, the ribs 43A extend horizontally over the whole width of the plug hold-down plate 40 at upper and lower positions on the hold-down plate 40. One rib 43B extends vertically from the upper horizontal rib 43A to the upper edge of the plug hold-down plate 40 and another rib 43B extends vertically from the lower horizontal rib 43A to the lower edge of the plug hold-down plate 40.

Figure 8:
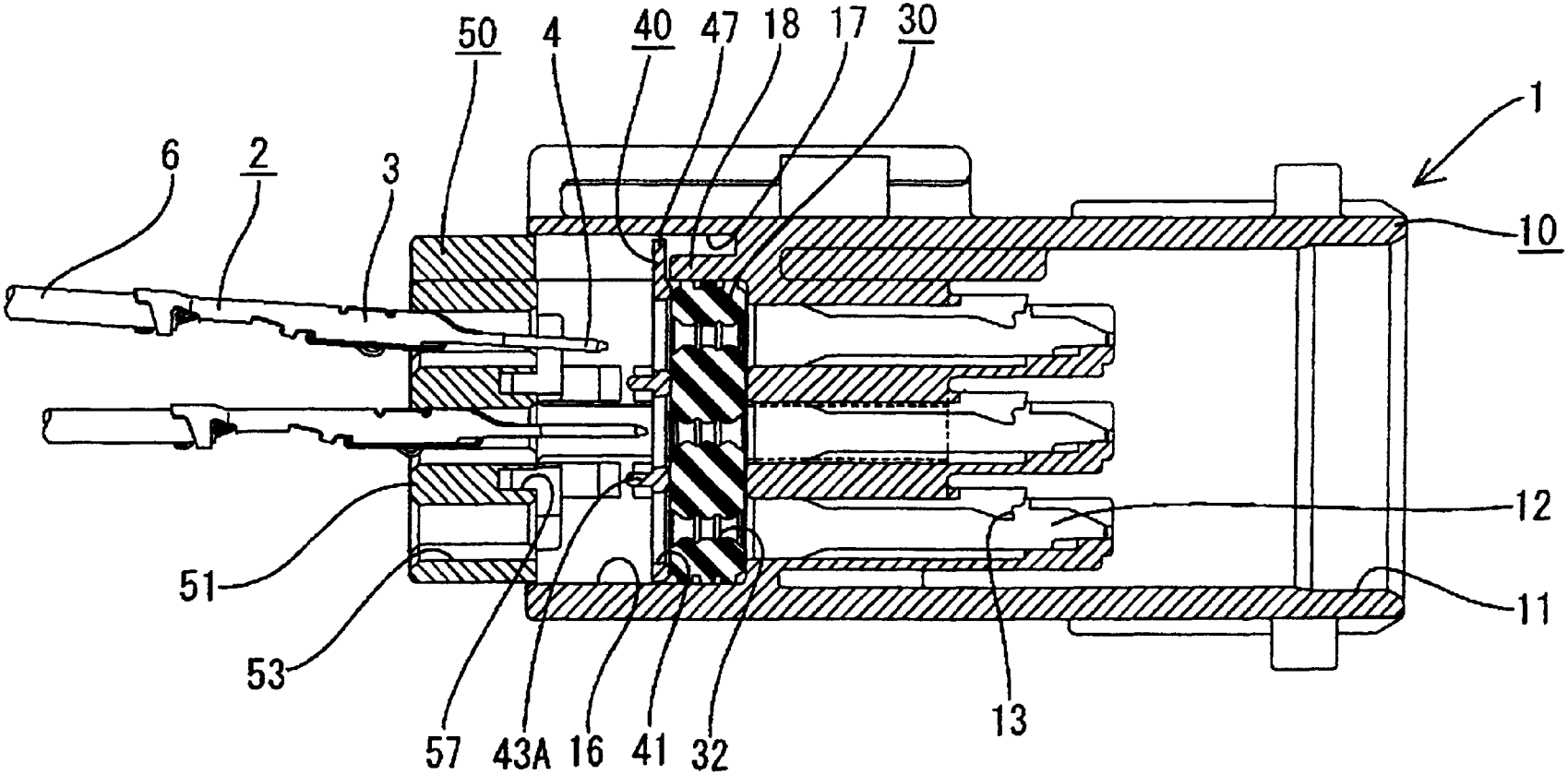
FIG. 8 is a side sectional view showing the holder.
Figure 12:
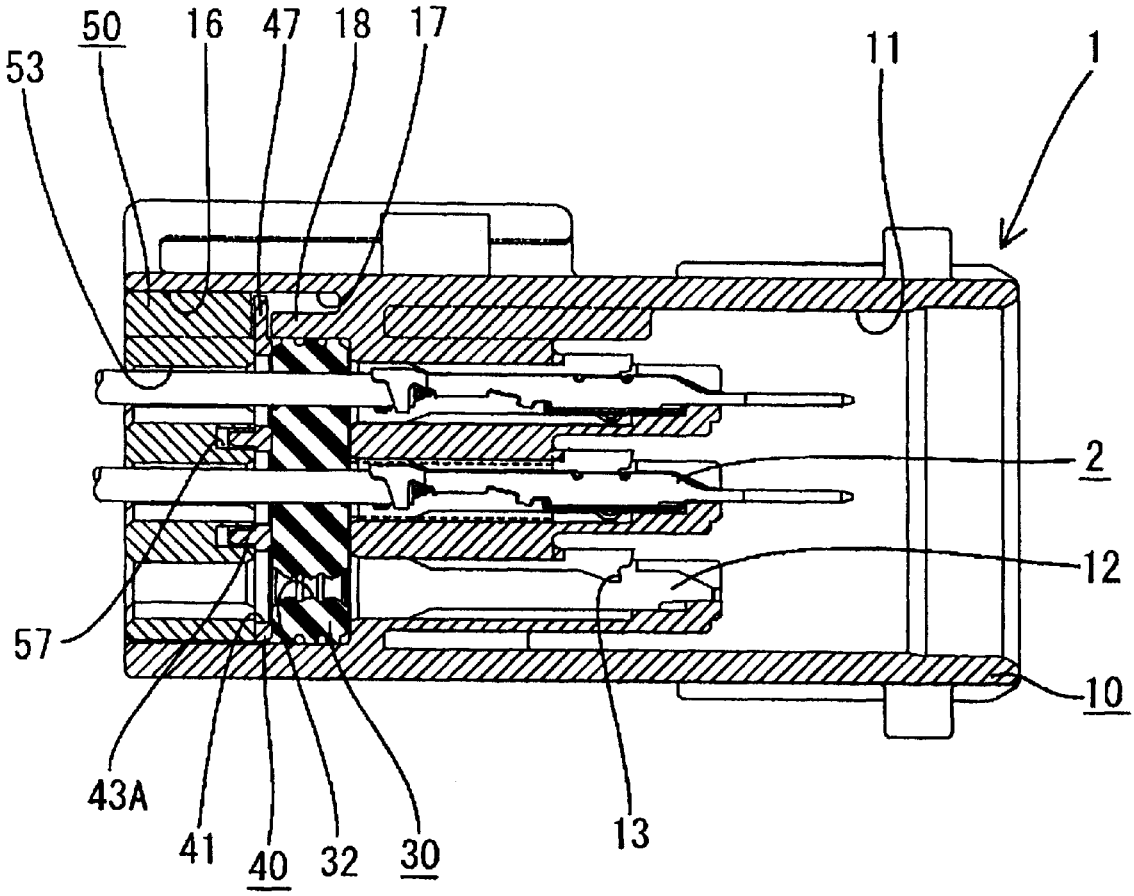
FIG. 12 is a side sectional view showing the holder.

A front stop 47 projects from the upper end of the plug hold-down plate 40. As shown in FIG. 1, a groove 17 is formed on a ceiling wall of the plug mounting receptacle 16 to the position of the innermost surface of the plug mounting 16. A receiving projection 18 is formed on the innermost surface of the groove 17 to the position of the rear surface of the rubber plug 30. The plug hold-down plate 40 is inserted into the plug mounting receptacle 16 so that the front stop 47 fits in the groove 17. The front stop 47 contacts the receiving projection 18 when the plug hold-down plate 40 is pressed into close contact with the rear surface of the rubber plug 30. Therefore the plug hold-down plate 40 is prevented from being inserted forward more than required (see FIGS. 8 and 12).

Figure 7:
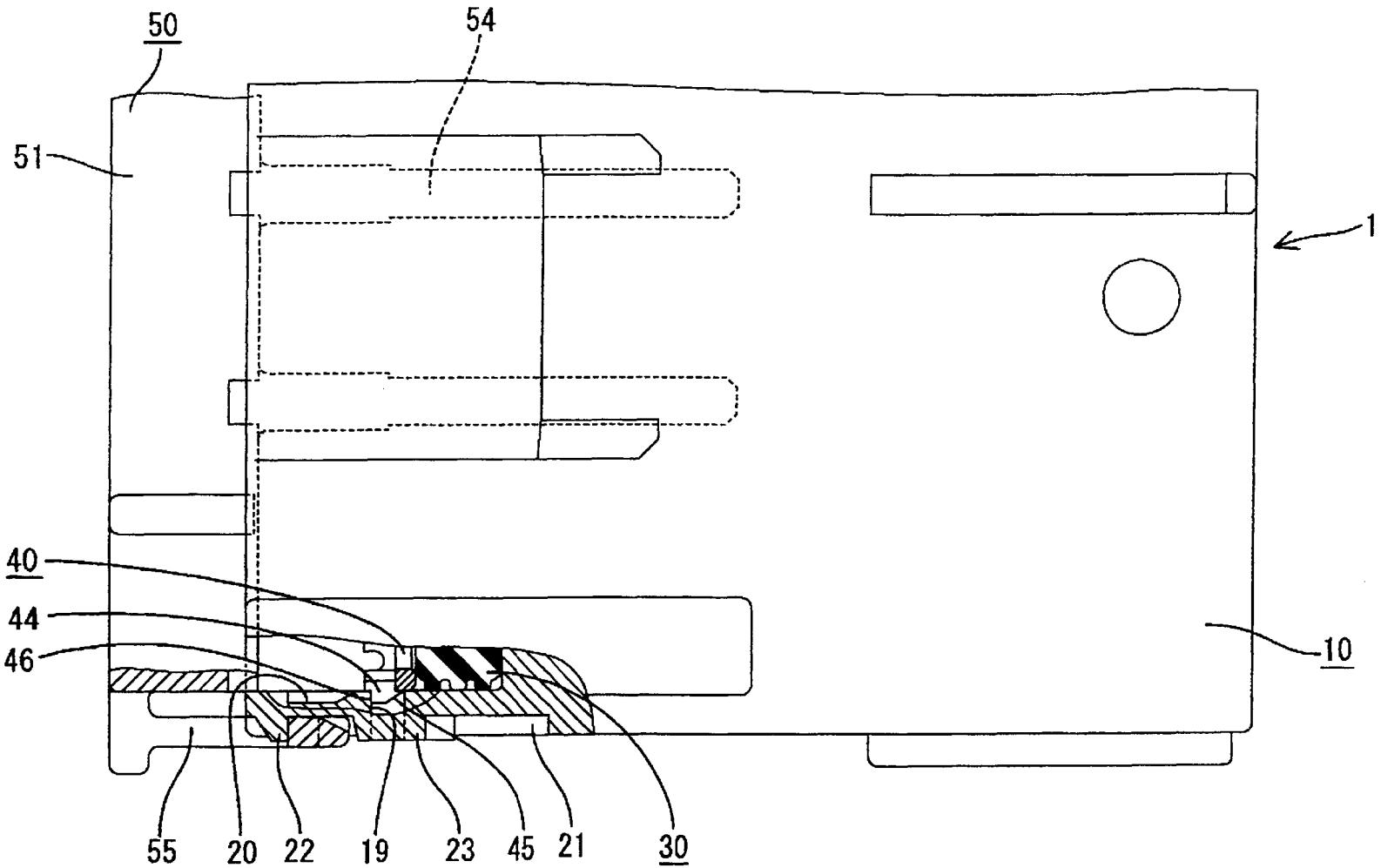
FIG. 7 is a partly cut-out plan view showing the holder.
Figure 11:
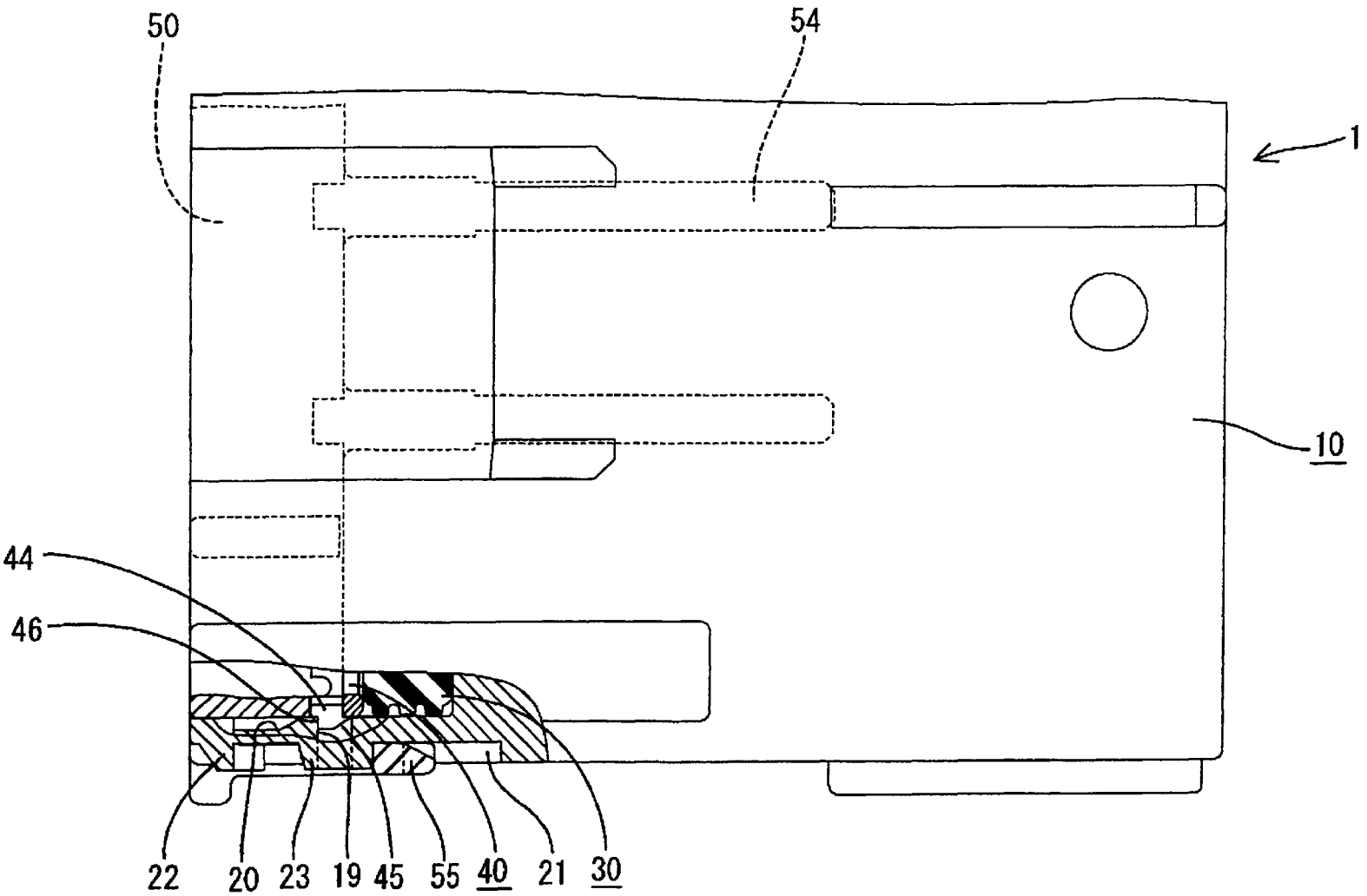
FIG. 11 is a partly cut-out plan view showing the holder.

Upper and lower locking projections 44 project laterally from each side edge of the plug hold-down plate 40 at locations aligned with the upper and lower horizontal ribs 43A. Each locking projection 44 has a tapered front surface 45 and a locking rear surface 46 aligned perpendicular to an installation/removal direction of the rubber plug 30. The locking surface 46 and a locking/receiving portion 19 formed in the mounting receptacle 16 are locked to each other. As shown in FIGS. 7 and 11, the locking/receiving portions 19 are formed at four positions (two upper positions and two lower positions) corresponding to the positions of the locking projections 44 such that the locking/receiving portion 19 penetrates through both side walls of the mounting receptacle 16. A slide groove 20 is formed on the inner surface of the side wall of the mounting receptacle 16 and extends from the rear edge of the side wall to a position rearward from the locking/receiving portion 19 by a predetermined dimension. Thus, the locking projection 44 can pass through the slide groove 20. The front end of the slide groove 20 is tapered inward and connected with the inner surface of the mounting receptacle 16. The plug hold-down plate 40 can be inserted and pressed into the mounting tube 16 so that the locking projection 44 fits in the slide groove 20. As a result, the plug hold-down plate 40 slightly curves elastically, and the tapered surface 45 of the locking projection 44 rides over the tapered front end surface of the slide groove 20. The locking projection 44 then fits in the locking/receiving portion 19, and the locking surface 46 and the rear end surface of the locking/receiving portion 19 are locked to each other. Thus, the plug hold-down plate 40 is prevented from slipping off rearward.

Figure 5:
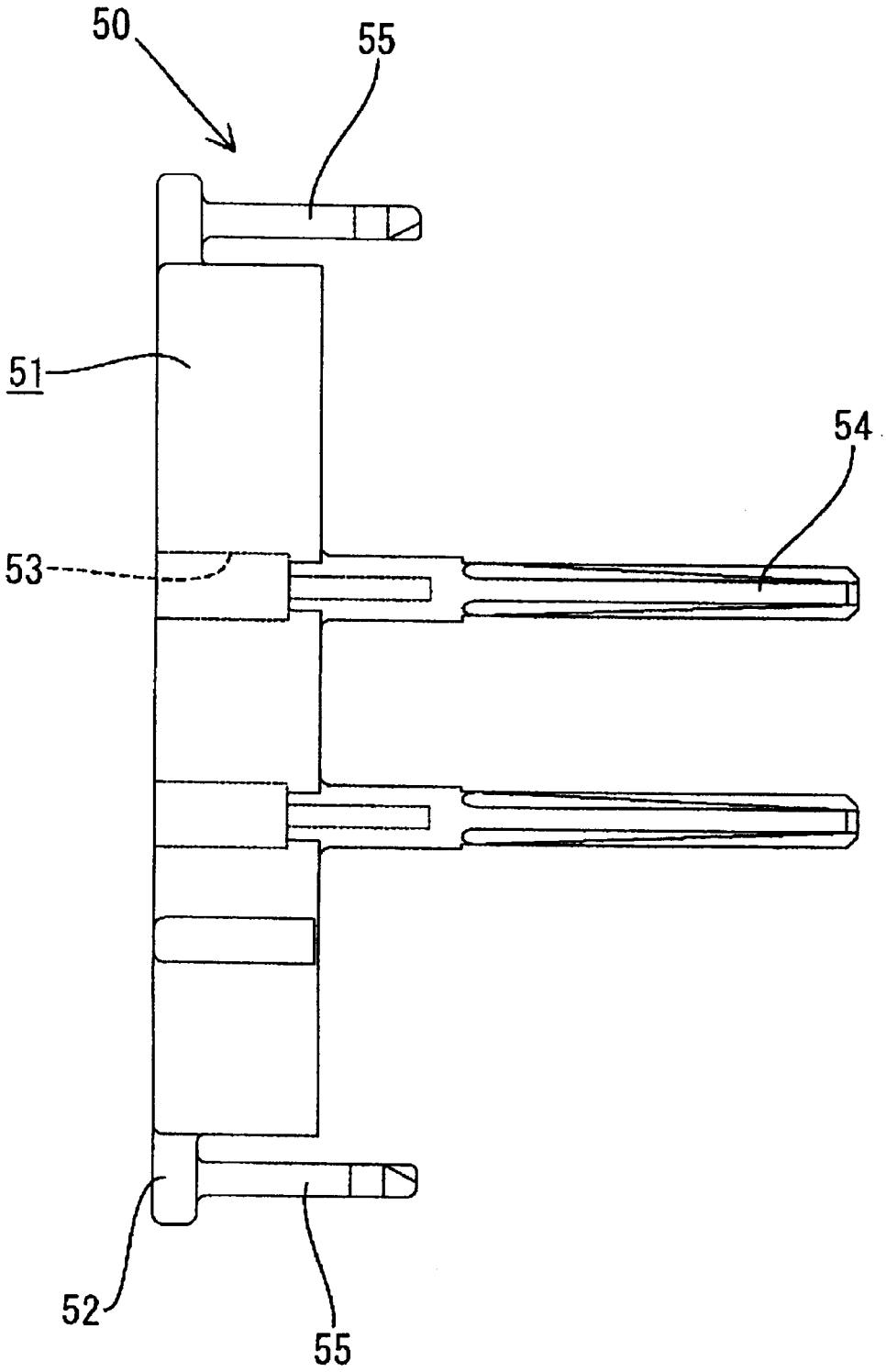
FIG. 5 is a plan view showing a holder.

The holder 50 is the last part to be mounted in the mounting receptacle 16 and is disposed to the rear of the plug hold-down plate 40 in the mounting receptacle 16. As shown in FIG. 5, the holder 50 has a base 51 that is closely fittable in the mounting receptacle 16, two locking plates 55 formed at both sides of the base 51 in its widthwise direction, and two projections 54 formed on the front surface of the base 51. The holder 50 can be held in the male housing 10 at a temporary locking position spaced from the rear surface of the plug hold-down plate 40 and at a main locking position close to the rear surface of the plug hold-down plate 40.

As shown in FIG. 1, terminal insertion holes 53 penetrate through the base 51 of the holder 50 at positions corresponding to the cavities 12 and the electric wire insertion holes 32 in the rubber plug 30. Each terminal insertion hole 53 is substantially quadrangular, and is configured to receive one of the male terminal fittings 2 without loosening of the body 3 thereof. The projections 54 project forward from positions on the front surface of the base 51 corresponding to the projection insertion hole 42 of the plug hold-down plate 40. Projection insertion holes 14 and 34 are formed on the male housing 10 and the rubber plug 30 respectively in positions that correspond to the projections 54 (see FIG. 9). Thus, the projection 54 can be inserted into the projection insertion holes 14, 34, and 43 to guide the holder into the mounting tube 16.

Figure 6:
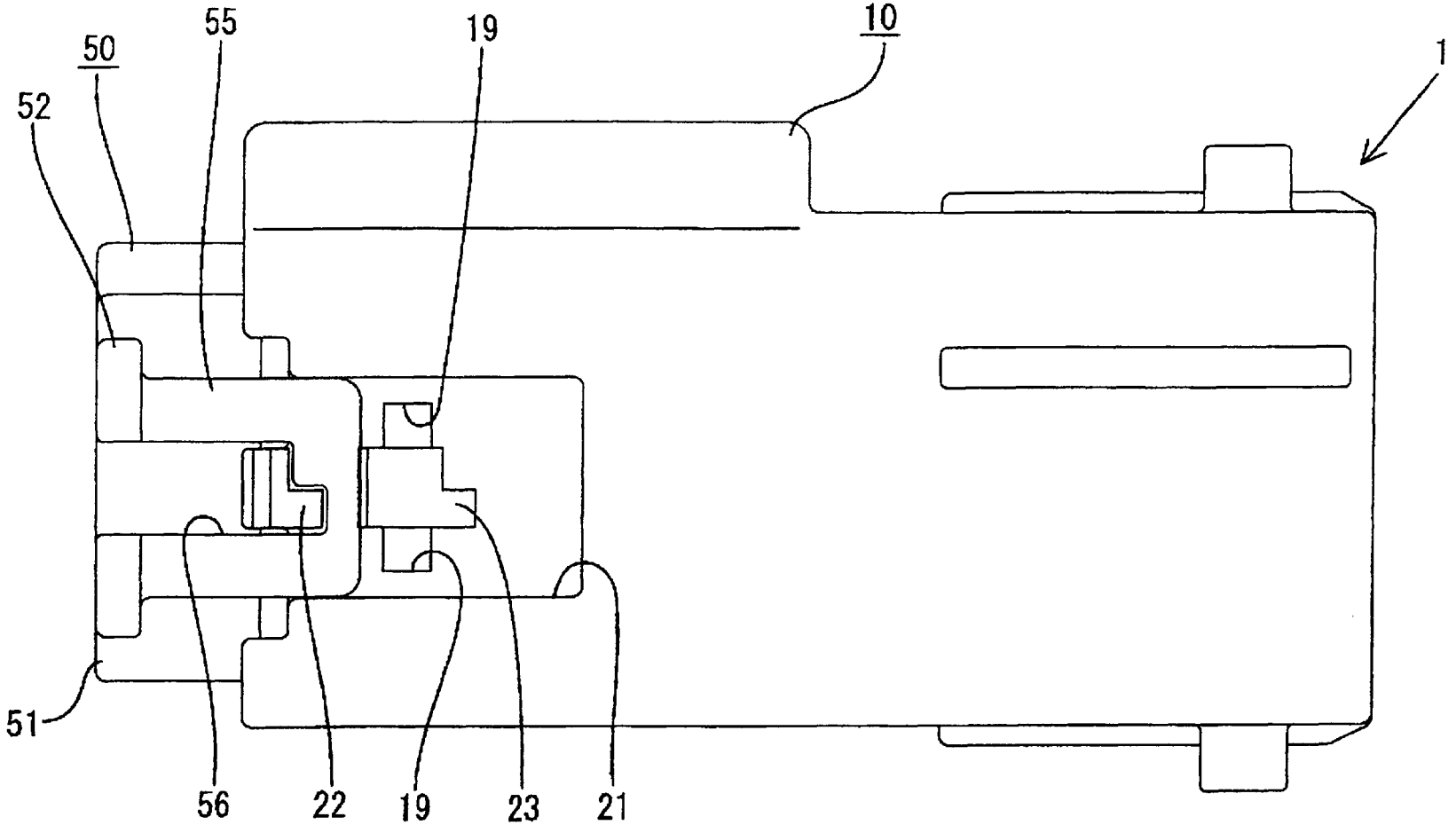
FIG. 6 is a side view showing a state in which the holder is held at a temporary locking position.
Figure 10:
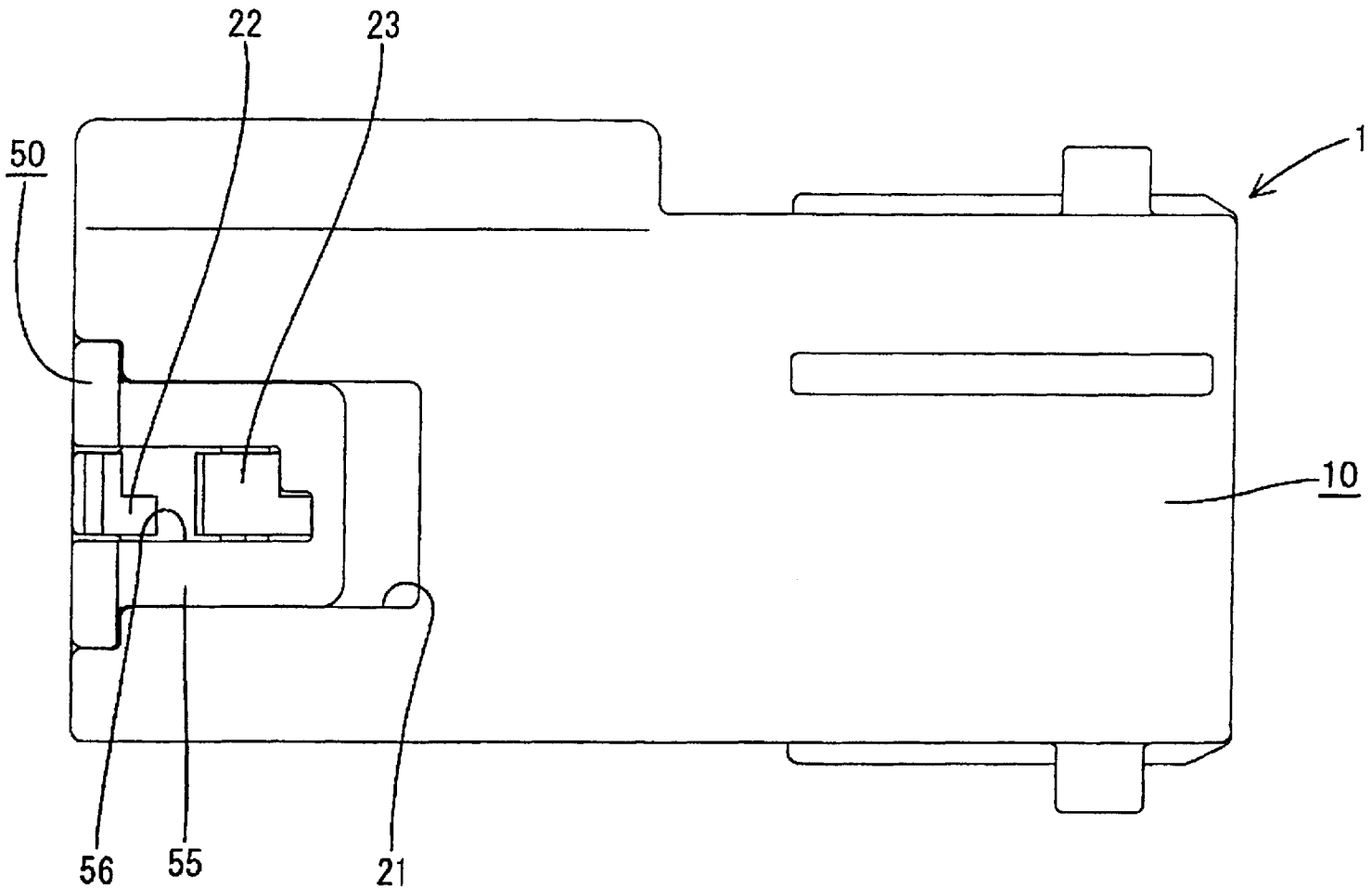
FIG. 10 is a side view showing a state in which the holder is held at a main locking position.

The locking plate 55 extends forward from a pedestal 52 that projects from both side surfaces of the base 51. The locking plate 55 is locked to the mounting receptacle 16. As shown in FIGS. 6 and 10, a cut-out 56 is formed substantially in the vertical center of the locking plate 55 from a root thereof along its extended direction by a predetermined length. A guide groove 21 is formed on the outer surface of the mounting receptacle 16 for slidably guiding the locking plate 55. A temporary locking projection 22 and a main locking projection 23 are formed side by side in a front-to-back direction on a sliding surface of the guide groove 21 on which the inner surface of the liking plate 55 slides.

As shown in FIGS. 6 and 7, the front edge of the locking plate 55 rides over the temporary locking projection 22 when the holder 50 is fitted in the mounting tube 16. Thus, the temporary locking projection 22 fits in the front edge of the cut-out 56 and the front edge of the locking plate 55 contacts the main locking projection 23. Accordingly, the holder 50 is held at the temporary locking position with the base 51 of the holder 50 projecting rearward from the rear surface of the male housing 10. The male terminal fitting 2 is inserted into the male housing 10 while the holder 50 is held at the temporary locking position. This insertion causes the body 3 of the male terminal fitting 2 to be received closely in the terminal insertion hole 53. Thus, the inner surface of the terminal insertion hole 53 guides the body 3 and the posture of the male terminal fitting 2 can be corrected.

As shown in FIGS. 10 and 11, the holder 50 is pressed further so that the front edge of the locking plate 55 rides over the main locking projection 23, and the main locking projection 23 fits in the cut-out 56. Additionally, the root of the locking plate 55 strikes against the rear edge of the mounting receptacle 16. As a result, the holder 50 is held at the main locking position.

An escape cavity 57 is formed on the front surface of the base 51 at a position corresponding to the ribs 43A and 43B of the plug hold-down plate 40. The escape cavity 57 is capable of accommodating the ribs 43A and 43B. Thus, the front surface of the holder 50 contacts the rear surface of the plug hold-down plate 40 closely when the holder 50 is pressed to the main locking position. The holder 50, at the main locking position, is accommodated completely inside the mounting receptacle 16.

The waterproof connector of the present invention is assembled by initially inserting the rubber plug 30 into the mounting receptacle 16 of the male housing 10 so that the convexity 15 fits into the positioning hole 33 and guides the rubber plug 30 into close contact with the innermost surface of the mounting receptacle 16. The plug hold-down plate 40 then is fitted in the mounting tube 16. At this time, the front stop 47 of the plug hold-down plate 40 fits in the groove 17 of the mounting receptacle 16, and the plug hold-down plate 40 is pressed into the mounting receptacle 16 by inserting the locking projection 44 into the slide groove 20. The tapered surface 45 of the locking projection 44 rides over the front end surface of the slide groove 20, and the locking projection 44 fits in the locking/receiving portion 19. As a result, the locking surface 46 and the rear end surface of the locking/receiving portion 19 are locked to each other and prevent the plug hold-down plate 40 from slipping off. At this time, the front surface of the plug hold-down plate 40 closely contacts the rear surface of the rubber plug 30 and holds down the rubber plug 30. Thus the plug hold-down plate 40 prevents the rubber plug 30 from moving freely rearward. An operator may try to press the plug hold-down plate 40 forward. However, the front stop 47 strikes against the front end of the receiving portion 18. Thus, the plug hold-down plate 40 cannot be pressed further, and excessive elastic deformation of the rubber plug 30 by the plug hold-down plate 40 is prevented.

The holder 50 then is mounted in the mounting receptacle 16 so that the projection 54 sequentially is inserted into the projection insertion holes 42, 34, and 14 formed respectively on the plug hold-down plate 40, the rubber plug 30, and the male housing 10. Thus, the holder 50 is positioned vertical and horizontal positioning during mounting in the male housing 10. Additionally, both locking plates 55 fit in the guide groove 21. At this time, the front end of the locking plate 55 rides over the temporary locking projection 22. As a result, the holder 50 is pressed into the mounting receptacle 16 while the locking plate 55 flexes outward. The temporary locking projection 22 fits in and locks to the cut-out 56 so that the holder 50 is held at the temporary locking position projecting rearward from the male housing 10 (see FIGS. 6 through 9).

The male terminal fitting 2, with the electric wire 6 crimped to its barrel 5, is inserted into the male housing 10 from the terminal insertion hole 53 of the holder 50. Thus, the male terminal fitting 2 passes through the through-hole 41 of the hold-down plate 40 and through the inside of the electric wire insertion hole 32 of the rubber plug 30, with the male terminal fitting 2 widening the electric wire insertion hole 32. The male terminal fitting 2 then is locked in the cavity 12 by the lance 13. The tab 4 of the male terminal fitting 2 could be inserted obliquely into the terminal insertion hole 53 of the holder 50. However, the body 3 fits closely in the terminal insertion hole 53, and the posture of the male terminal fitting is corrected before the front end of the tab 4 reaches the electric wire insertion hole 32. Therefore it is possible to prevent the tab 4 from sticking into the electric wire insertion hole 32 of the rubber plug 30, and the male terminal fitting 2 is inserted smoothly into the electric wire insertion hole 32.

The holder 50 is pressed to the main locking position after the insertion of the male terminal fitting 2 is completed. The operator may pull the male terminal fitting 2 out from the cavity 12, with the holder 50 held at the temporary locking position. In this case, the plug hold-down plate 40 holds down the rubber plug 30 and prevents it from moving freely rearward. Thus it is possible to prevent the rubber plug 30 from moving rearward while the male terminal fitting 2 is being removed.

The holder 50 can be pressed further forward from the temporary locking position to the main locking position after the male terminal fittings 2 are accommodated in the cavities 12. In this state, the entire holder 50 is accommodated completely inside the mounting receptacle 16 (see FIGS. 10 through 12), with the rib 43 of the plug hold-down plate 40 accommodated in the escape cavity 57 and with the rear surface of the base 51 of the holder 50 in close contact with the plug hold-down plate 40.

As explained in the foregoing description, the male terminal fitting 2 might have to be pulled out from the cavity 12 after it is mounted therein. However, it is possible to prevent the rubber plug 30 from moving rearward with the male terminal fitting 2, even though the holder 50 is held at the temporary locking position. This is because the rubber plug hold-down plate 40 holds down the rubber plug 30, with the rubber plug hold-down plate 40 in close contact with the rear surface of the rubber plug 30.

The plug hold-down plate 40 is substantially flat and plate-shaped, and is aligned substantially perpendicular to the insertion direction of the male terminal fitting 2. Thus the space for mounting the plug hold-down plate 40 is small, and the male housing 10 has a short longitudinal dimension. The flat shape of the plug hold-down plate 40 could lead to a low strength and a probability of bending deformation. However the plug hold-down plate 40 is reinforced with the ribs 43A and 43B and has the necessary strength.

The escape cavity 57 is formed on the holder 50 disposed in the rear of the plug hold-down plate 40. The escape cavity 57 is capable of accommodating the ribs 43A and 43B. Thus, the front surface of the holder 50 closely contacts the rear surface of the plug hold-down plate 40. Accordingly it is possible to reduce the dimension from the front end surface of the male housing to the rear end surface of the holder 50 held at the main locking position. Thereby it is possible to reduce the length of the male waterproof connector 1.

The invention is not limited to the embodiment described with reference to the drawings, but the following modes are included in the technical scope of the present invention. The present invention can be embodied by making various modifications if they do not depart from the gist of the present invention.

The plug hold-down plate 40 described above is separate from the male housing 10 and prevents a free movement of the rubber plug 30. However, any plug hold-down member that prevents the rubber plug 30 from being dislocated rearward can be used. For example, it is possible to use a rubber plug projecting from and integral with the inner surface of the mounting tube and capable of holding down the periphery of the rear surface of the rubber plug.

The plug hold-down plate 40 described above is flat and plate-shaped, and is capable of holding down the rear surface of the rubber plug 30. However, it is possible to use a ring-shaped plug hold-down member that is fittable on the peripheral surface of the rubber plug and capable of being locked to the inner surface of the mounting tube.

In the above-described embodiment, when the holder 50 is pressed to the main locking position, the holder 50 contacts the plug hold-down plate 40 closely. However, the holder 50 may not be pressed to the position at which the holder 50 contacts the plug hold-down plate 40 closely.

In the above-described embodiment, when the holder 50 is mounted on the main locking position, the entire holder 50 is accommodated completely in the male housing 10. However, the entire holder 50 may project from the rear surface of the male housing 10, with the holder 50 held at the main locking position.

What is claimed is:

1. A waterproof connector comprising:

male terminal fittings, each said male terminal fitting having a tab projecting forward from a body that is thicker than said tab;

a connector housing having a plurality of cavities capable of accommodating said male terminal fittings respectively;

a collective-type rubber plug disposed on a rear surface of said connector housing and configured for closely contacting a periphery of each of said male terminal fittings, and having a plurality of electric wire insertion holes corresponding respectively to said cavities; and a holder through which a plurality of terminal insertion holes corresponding to said electric wire insertion holes respectively are formed and which is held in said connector housing at a temporary locking position disposed rearward from a rear surface of said rubber plug and a main locking position disposed forward from said temporary locking position, wherein said male terminal fittings are inserted into said cavities through said terminal insertion holes and said electric wire insertion holes, with said holder held at said temporary locking position; and in a process of inserting said male terminal fittings into said cavities, a posture of each of said male terminal fittings is corrected by fitting said body part thereof in each of said terminal insertion holes; and after said male terminal fittings are inserted into said cavities respectively, said holder is moved from said temporary locking position to said main locking position, said connector housing being provided with a plug hold-down member separate from said holder and capable of preventing said rubber plug from freely moving rearward when said holder is at said temporary locking position.

2. The connector of claim 1, wherein said plug hold-down member is flat and plate-shaped, and is perpendicular to an insertion direction of said male terminal fittings; a front surface of said plug hold-down member holds down said rear surface of said rubber plug; and a reinforcing rib projects on said rear surface of said plug hold-down member, and an escape concavity capable of accommodating said rib being formed on said holder.

3. A waterproof connector comprising:

a housing having opposite front and rear ends, a receptacle extending into the rear end and having a front surface facing the rear end of the housing, a plurality of cavities extending from the front surface of the receptacle toward the front end of the housing for accommodating terminal fittings;

a plug formed from an elastomeric sealing material, the plug being disposed in the receptacle of the housing and substantially covering the front surface of the receptacle, the plug having a plurality of insertion holes aligned respectively with said cavities and configured for closely contacting a periphery of each of the terminal fittings;

a plug hold-down member locked in the receptacle adjacent the plug for holding the plug in the receptacle; and a holder mounted to the receptacle and movable from a temporary locking position where the holder is spaced from the plug hold-down member to a main locking position where the holder is adjacent the plug hold-down member, wherein the plug hold-down member holds the plug in the receptacle and resists forces generated on the elastomeric plug in response to removal of one of said terminal fittings.

4. The connector of claim 3, wherein the plug hold-down member is substantially plate shaped.

5. The connector of claim 4, wherein the plug hold-down member has a plurality of insertion holes aligned respectively with the insertion holes of the plug.

6. The connector of claim 5, wherein the plug hold-down member has a plurality of reinforcing ribs for preventing bending of the plug hold-down member.

7. The connector of claim 6, wherein the reinforcing ribs face rearwardly on the plug hold-down member, and wherein the holder has at least one cavity facing forwardly and configured for receiving the reinforcing ribs.

8. The connector of claim 7, wherein the plug hold-down member has a stop for engaging a receiving projection in the receptacle for limiting forward movement of the plug hold-down member.

9. The connector of claim 4, further comprising a plurality of terminal fittings insertable through the holder, the plug hold-down member and the plug and into the respective cavities, the holder having insertion holes dimensioned for closely engaging the terminal fittings and aligning the terminal fittings while the holder is in the temporary locking position and before the terminal fittings reach the cavities.

10. The connector of claim 3, wherein the housing is unitarily formed from a synthetic resin.

11. The connector of claim 3, wherein the plug is formed from rubber.

* * * * *